US008467557B2

(12) United States Patent
Miller et al.

(10) Patent No.: US 8,467,557 B2
(45) Date of Patent: Jun. 18, 2013

(54) COAXIAL SPEAKER SYSTEM WITH IMPROVED TRANSITION BETWEEN INDIVIDUAL SPEAKERS

(75) Inventors: Brian Howard Miller, Jacksonville, FL (US); Charles Emory Hughes, II, Gastonia, NC (US); Jonathan Neil Hart, Salt Lake City, UT (US)

(73) Assignee: MS Electronics LLC, Overland Park, KS (US)

( * ) Notice: Subject to any disclaimer, the term of this patent is extended or adjusted under 35 U.S.C. 154(b) by 755 days.

(21) Appl. No.: 12/566,433

(22) Filed: Sep. 24, 2009

(65) Prior Publication Data

US 2011/0069857 A1 Mar. 24, 2011

(51) Int. Cl.
*H04R 25/00* (2006.01)

(52) U.S. Cl.
USPC ..... 381/340; 381/335; 381/342; 381/182; 381/186

(58) Field of Classification Search
USPC ..... 381/340–342, 345–354, 335, 336, 381/182, 186; 181/144, 147, 199
See application file for complete search history.

(56) References Cited

U.S. PATENT DOCUMENTS 3,796,839 A * 3/1974 Torn ..... 381/432
4,283,606 A * 8/1981 Buck ..... 381/342
5,062,139 A * 10/1991 Christensen ..... 381/184
5,181,253 A * 1/1993 Jordan ..... 381/184
5,548,657 A * 8/1996 Fincham ..... 381/182
6,963,650 B2 * 11/2005 Combest ..... 381/182
7,142,680 B2 * 11/2006 Gelow et al. ..... 381/182
7,203,329 B2 4/2007 Alexander et al.
8,023,683 B2 * 9/2011 Lin ..... 381/387
8,130,994 B2 * 3/2012 Button et al. ..... 381/339
2010/0124340 A1 * 5/2010 Knieschewski ..... 381/87

* cited by examiner

*Primary Examiner* — Davetta W Goins
*Assistant Examiner* — Jasmine Pritchard
(74) *Attorney, Agent, or Firm* — Hovey Williams LLP

(57) ABSTRACT

A coaxial speaker system that minimizes detrimental sound wave reflections from its high frequency speaker. The coaxial speaker system includes a high frequency speaker coaxially mounted within a low frequency speaker. The high frequency speaker includes a sound reproducing membrane, a voice coil assembly and magnet assembly for actuating the sound reproducing membrane in response to an electrical audio signal, and optionally a wave guide horn for directing sound waves produced by the sound reproducing membrane. The wave guide horn has a throat disposed adjacent the sound reproducing membrane and a mouth disposed opposite the throat. The low frequency speaker also includes a sound reproducing membrane assembly and a voice coil assembly and magnet assembly for actuating the sound reproducing membrane assembly in response to an electrical audio signal. At least a portion of the low frequency speaker sound reproducing membrane assembly is positioned adjacent the mouth of the wave guide horn (or adjacent the outer edge of the high frequency speaker sound reproducing membrane when no horn is provided) to inhibit the detrimental effects of sound waves produced by the high frequency speaker that reflect off the low frequency speaker.

25 Claims, 7 Drawing Sheets

A-A

A-A

A-A

A-A

A-A

B-B

A-A

COAXIAL SPEAKER SYSTEM WITH IMPROVED TRANSITION BETWEEN INDIVIDUAL SPEAKERS

BACKGROUND

The present invention relates to loudspeaker systems. More particularly, the invention relates to an improved coaxial loudspeaker system.

Loudspeaker systems typically include two or more separate speakers (sometimes referred to as "drivers"), each configured for reproducing sounds within a selected audio frequency band. For example, a loudspeaker system may include a woofer speaker for reproducing sounds in a relatively low frequency band, a mid-range speaker for reproducing sounds in a mid-range frequency band, and a tweeter speaker for reproducing sounds in a relatively high frequency band. Those skilled in the art will appreciate that any number of speakers including sub-woofers, super tweeters, etc. may also be provided. Multi-speaker loudspeaker systems also include a crossover filter network or circuit for separating an incoming electrical audio signal into separate bands for delivery to the voice coils of the separate speakers to ensure that each speaker only receives audio signals corresponding to its frequency band.

It is common to mount the individual speakers of a loudspeaker system in an enclosure in a vertically or horizontally spaced-apart orientation. Unfortunately, this results in misalignment of the acoustic centers of the speakers. Because listeners are typically not the same distance and/or angle from all of the individual speakers, sounds from some of the speakers reach the listeners before the sounds from other speakers, causing an uneven or nonuniform overall sound reproduction, especially for frequencies near the crossover regions of the speakers.

Coaxial speaker systems have been developed to greatly minimize the above-described problems associated with conventional speaker systems. Coaxial speakers include two or more separate speakers that are mounted on a common central axis, typically with a high frequency speaker mounted inside of a low frequency speaker. In coaxial speaker systems, there is no vertical or horizontal offset of the acoustic centers of the speakers and therefore greatly reduced offset of sounds emanating from the speakers. The only remaining offset may be in the separation of the acoustic centers of the drivers along the common central axis.

Applicant has discovered, however, that coaxial speakers may suffer from their own limitations. Specifically, applicant has discovered that some of the sound waves from the high frequency speaker may be projected rearward toward the low frequency speaker, due to a combination of edge diffraction and insufficient directivity control, and bounce or reflect off the low frequency speaker. These reflected sound waves cause undesirable variations in the performance and undesirable off-axis lobes in the spatial performance of the speaker system due to the path length differences between the direct sound from the high frequency speaker and the reflections of these sounds from the low frequency speaker.

Accordingly, there is a need for an improved coaxial speaker that overcomes the limitations of known existing coaxial speakers.

SUMMARY

The present invention solves the above-described problems and provides a distinct advance in the art of coaxial speaker systems. More particularly, the present invention provides an improved coaxial speaker that minimizes the reflection of sound waves originating from its high frequency speaker.

Applicant has discovered that the above-described sound wave reflections are at least partially caused by the abrupt transition between the high frequency speaker and the low frequency speaker of prior art coaxial speakers and can be minimized by smoothing or minimizing this transition. Specifically, applicant discovered that superior sound reproduction can be created by a speaker assembly having a relatively smooth transition between a high frequency speaker and a sound reproducing membrane assembly of the low frequency speaker.

A particular embodiment of the present invention comprises a high frequency speaker coaxially mounted within a low frequency speaker. The high frequency speaker includes a sound reproducing membrane, a voice coil assembly and magnet assembly for actuating the sound reproducing membrane in response to an electrical audio signal, and a wave guide horn for directing sound waves produced by the sound reproducing membrane. The wave guide horn has a throat disposed adjacent the sound reproducing membrane and a mouth disposed opposite the throat.

The low frequency speaker also includes a sound reproducing membrane assembly and a voice coil assembly and magnet assembly for actuating the sound reproducing membrane assembly in response to an electrical audio signal. In accordance with an important aspect of the invention, at least a portion of the low frequency speaker sound reproducing membrane assembly is positioned adjacent the mouth of the wave guide horn to greatly minimize, or preferably eliminate, the increased path length and travel time of the sound waves produced by the high frequency speaker reflecting off the low frequency speaker.

In a specific embodiment of the speaker assembly, the low frequency speaker sound reproducing membrane assembly includes a substantially flat ring-shaped diaphragm and a driving element. The ring-shaped diaphragm has an inside diameter edge positioned adjacent the mouth of the wave guide horn and an outside diameter edge connected to a flexible surround. The driving element is positioned between the ring-shaped diaphragm and the low frequency speaker voice coil assembly for transferring vibrations from the voice coil assembly to the ring-shaped diaphragm.

In other embodiments of the speaker assembly, the low frequency speaker sound reproducing membrane assembly includes a woofer diaphragm and a flat, convex, or concave shaped cap. The woofer diaphragm includes an inner diameter edge connected to its voice coil assembly and an outer diameter edge connected to a flexible surround. The cap has an inside diameter edge positioned adjacent the mouth of the high frequency speaker wave guide horn and an outside diameter edge connected to a portion of the woofer diaphragm.

Other embodiments of the invention include low frequency speaker sound reproducing membrane assemblies of different configurations and shapes. As described in more detail below, the invention is not limited to any particular configuration or shape of the low frequency speaker sound reproducing membrane assembly.

This summary is provided to introduce a selection of concepts in a simplified form that are further described in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
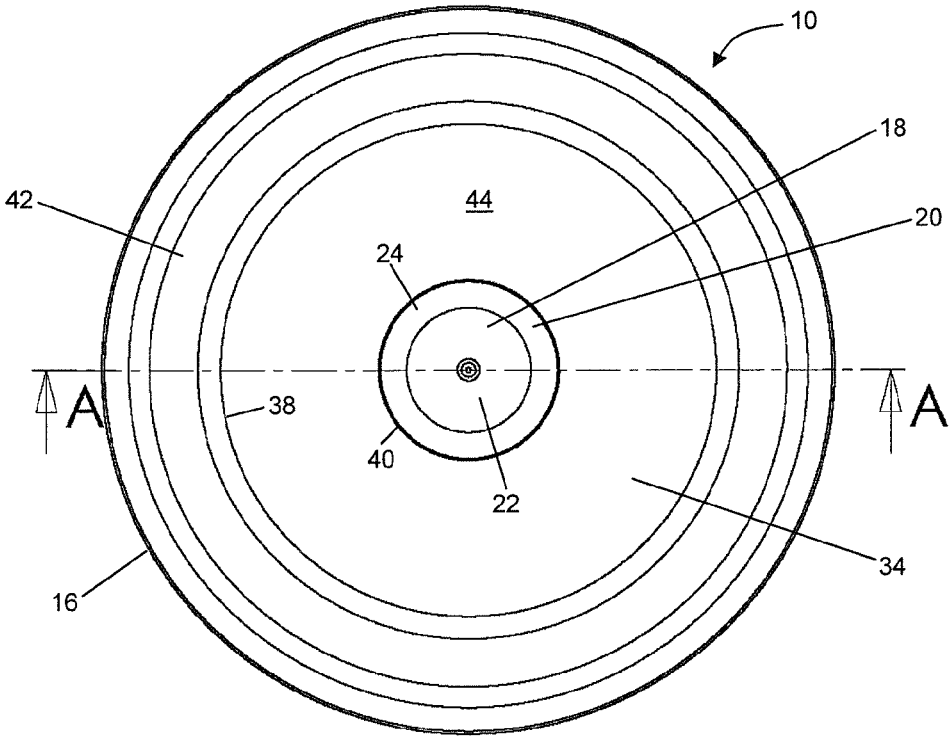
FIG. 1 is a plan or top view of a speaker assembly constructed in accordance with a first embodiment of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of embodiments of the invention references the accompanying drawings. The embodiments are intended to describe aspects of the invention in sufficient detail to enable those skilled in the art to practice the invention. Other embodiments can be utilized and changes can be made without departing from the scope of the claims. The following detailed description is, therefore, not to be taken in a limiting sense. The scope of the present invention is defined only by the appended claims, along with the full scope of equivalents to which such claims are entitled.

Figure 2:
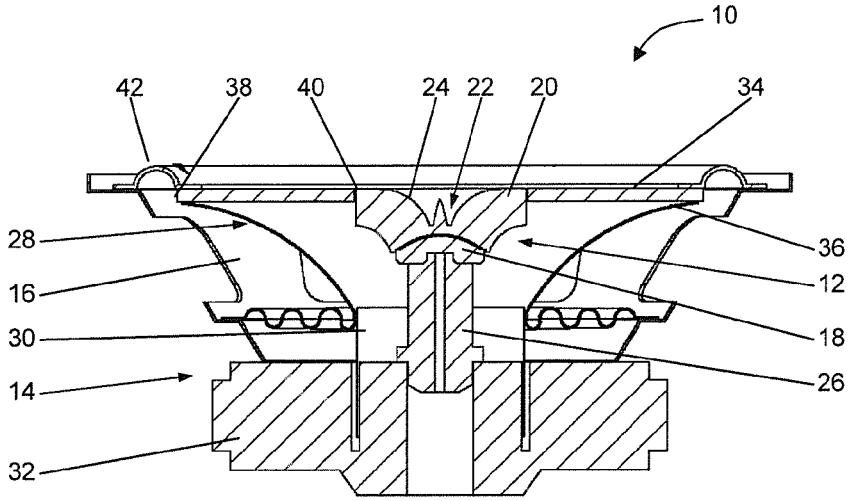
FIG. 2 is a vertical section view of the speaker assembly of FIG. 1 taken along the line A-A.

Turning now to the drawing figures, and initially FIGS. 1 and 2, a coaxial speaker assembly 10 constructed in accordance with a first embodiment of the invention is illustrated. The speaker assembly 10 broadly comprises a high frequency speaker 12 and a low frequency speaker 14 coaxially mounted within a chassis 16 or basket having an annular rim. The high frequency speaker 12 is configured for reproducing sounds in a relatively high frequency band, such as above 5 kHz, and the low frequency speaker 14 is configured for reproducing sounds in a relatively lower frequency band, such as below 500 Hz. However, the particular frequency bands reproduced by the speakers can be changed without altering the invention.

An embodiment of the high frequency speaker 12 broadly includes a sound reproducing membrane 18, a voice coil assembly and magnet assembly (not shown in detail) for actuating the sound reproducing membrane in response to an electrical audio signal, and a wave guide horn 20 for directing sound waves produced by the sound reproducing membrane. Specifics of this embodiment of the high frequency speaker are described in more detail in U.S. Pat. No. 7,203,329, hereby incorporated into the present application in its entirety by reference. In other embodiments of the invention, the high frequency speaker 12 may not be equipped with a wave guide horn.

The sound reproducing membrane 18 may be formed of any relatively stiff and thin material such as paper, metal, or plastic and may have a hemispherical dome shape or any other shape. The voice coil assembly and magnet assembly is conventional and may include a voice coil former, a voice coil, a permanent magnet, and a suspension device for aligning the voice coil former and voice coil within a gap formed in the permanent magnet.

The wave guide horn 20 has a throat 22 disposed adjacent the sound reproducing membrane 18 and a mouth 24 disposed opposite the throat. The wave guide horn may be of any size and shape but is preferably cone or funnel shaped with a circular cross-section as described in the '329 Patent referenced above.

The high frequency speaker 12 may also include a post 26 or other means for supporting and centering the high frequency speaker in the same axis as the voice coil assembly of the low frequency speaker. The post may be of any length to position the high frequency speaker a desired distance forward of the low frequency speaker voice coil assembly 30 and magnet assembly 32.

The low frequency speaker 14 also includes a sound reproducing membrane assembly 28, a voice coil assembly 30, and magnet assembly 32 for actuating the sound reproducing membrane assembly in response to an electrical audio signal. As described in more detail below, the sound reproducing membrane assembly 28 performs two primary functions: it reproduces low frequency sounds when activated by the voice coil assembly 30 and magnet assembly 32; and it provides a smooth transition between the mouth 24 of the wave guide horn 20 (or the high frequency speaker sound reproducing membrane 18 when no horn is provided) and components of the low frequency speaker.

In accordance with an important aspect of the invention, at least a portion of the low frequency speaker sound reproducing membrane assembly 28 is positioned adjacent the mouth 24 of the wave guide horn 20 to inhibit detrimental reflections of sound waves produced by the high frequency speaker from the low frequency speaker 14. This allows the high frequency speaker's sound waves to smoothly transition from the mouth 24 of the wave guide horn 20 onto the low frequency speaker sound reproducing membrane assembly 28 without excessive increase of the path length and/or travel time of these reflections that would otherwise degrade the sound quality of the speaker assembly. In embodiments of the invention that do not include a wave guide horn, at least a portion of the low frequency speaker sound reproducing membrane assembly 28 is positioned adjacent the high frequency speaker sound reproducing membrane 18 to achieve this same effect.

In the embodiment of the speaker assembly 10 shown in FIGS. 1 and 2, the low frequency speaker sound reproducing membrane assembly 28 includes a substantially flat ring-shaped diaphragm 34 and a driving element 36. The ring-shaped diaphragm 34 may be formed of any material including paper, cardboard, plastic, or even metal and in one embodiment is formed of a mesh-like fabric. An embodiment of the ring-shaped diaphragm 34 is approximately 3 mm thick and has a 154 mm diameter outside edge 38 and a 55 mm diameter inside edge 40. Other embodiments of the diaphragm 34 may be between 1-5 mm thick, 100-200 mm in outside diameter, and between 20-90 mm inside diameter.

The inside diameter edge 40 is positioned adjacent the mouth 24 of the wave guide horn and the outside diameter edge 38 is connected to a flexible surround 42. In the embodiment shown in FIGS. 1 and 2, the outer surface 44 of the ring-shaped diaphragm is either substantially co-planar or substantially parallel to the plane occupied by the outermost edge of the wave guide horn mouth 24. In embodiments that do not include a wave guide horn, the inside diameter edge 40 of the diaphragm 34 is positioned adjacent the high frequency speaker sound reproducing membrane 18 so that the diaphragm 34 is substantially co-planar with the outer edge or outer termination of the high frequency speaker sound reproducing membrane 18.

The driving element 36 is positioned between the ring-shaped diaphragm 34 and the low frequency speaker voice coil assembly 30 and is provided for transferring vibrations from the voice coil assembly to the ring-shaped diaphragm. The driving element may be formed of any material including paper, cardboard, plastic, or even metal. The driving element may be generally frustro-conical in shape or any other shape and includes an inside diameter portion attached to the low frequency speaker voice coil assembly and an outside diameter portion glued or otherwise affixed to the underside of the ring-shaped diaphragm 34. In the embodiment of FIGS. 1 and 2, the driving element is affixed to the underside of the ring-shaped diaphragm at a point below the flexible surround 42.

In operation, the sound reproducing membrane assemblies 18, 28 of the high frequency speaker 12 and the low frequency speaker 14 are driven by their respective voice coil assemblies and magnet assemblies when the speaker assembly 10 receives an electrical audio signal or signals from an amplifier or other source. The voice coil assembly 30 and magnet assembly 32 of the low frequency speaker directly drives the driving element 36 and indirectly drives the ring-shaped diaphragm 34 via the driving element. Similarly, the voice coil assembly and magnet assembly of the high frequency speaker 12 drives its sound reproducing membrane 18, and the resultant sound waves are shaped and directed outwardly by the wave guide horn 20. Importantly, because the inside diameter edge 40 of the ring-shaped diaphragm 34 is positioned adjacent to and generally co-planar with the mouth 24 of the wave guide horn 20, sound waves from the high frequency speaker 12 pass smoothly over the outer face of the ring-shaped diaphragm without any significant detrimental reflections. Although it is desirable for the ring-shaped diaphragm to be co-planar with the mouth of the wave guide horn, it may also be recessed or raised slightly and occupy a plane that is generally parallel with the plane occupied by the mouth of the wave guide horn. Also, as explained above the ring-shaped diaphragm may be adjacent the outer edge or outer termination of the high frequency speaker sound reproducing membrane 18 in embodiments without a wave guide horn.

Figure 3:
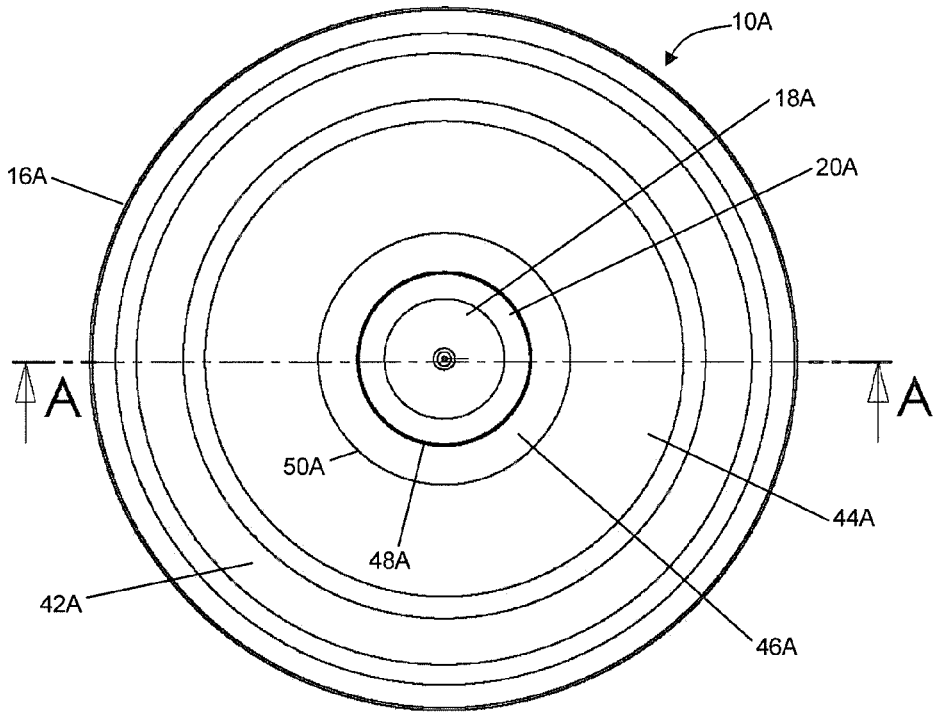
FIG. 3 is a plan or top view of a speaker assembly constructed in accordance with a second embodiment of the present invention.
Figure 4:
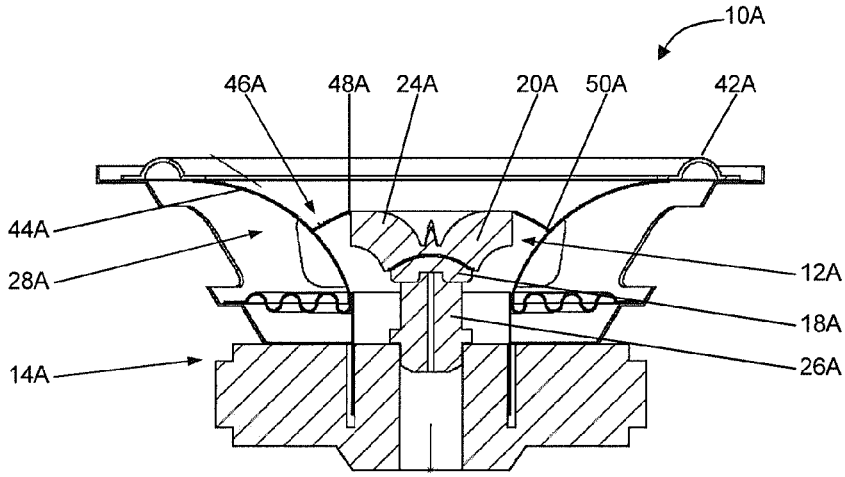
FIG. 4 is a vertical section view of the speaker assembly of FIG. 3 taken along the line A-A.

FIGS. 3 and 4 illustrate a speaker assembly 10A constructed in accordance with a second embodiment of the invention. Most of the components of the speaker assembly 10A are identical to the components of the speaker assembly 10, so only the differences are described herein. In the speaker assembly 10A, the post 26A or support of the high frequency speaker 12A is shorter than the post of the speaker assembly 10 so that the high frequency speaker is not as far forward of the low frequency speaker. However, the particular length of the post 26A, and therefore the positioning of the high frequency speaker relative to the low frequency speaker, is not critical to the invention.

Another difference between the speaker assembly 10A and the speaker assembly 10 is that the low frequency speaker sound reproducing membrane assembly 28A includes a woofer diaphragm 44A and a convex shaped cap 46A. The woofer diaphragm 44A is similar to the driving element 36 of the speaker assembly 10, but it includes an inner diameter edge connected to its voice coil assembly and an outer diameter edge connected directly to a flexible surround 42A (rather than indirectly connected). The cap 46A has an inside diameter edge 48A positioned adjacent to the mouth 24A of the high frequency speaker wave guide horn 20A (or adjacent the outer edge or outer termination of the sound reproducing membrane 18A when no horn is provided) and an outside diameter edge 50A connected to a portion of the woofer diaphragm 44A. The cap may be formed of any suitable material including paper, cardboard, plastic, or even metal. In one embodiment, the cap is approximately 0.7 mm thick and has a 95 mm diameter outside edge and a 55 mm diameter inside edge.

The speaker assembly 10A operates in a similar manner as the speaker assembly 10. Specifically, the sound reproducing membrane assemblies of the high frequency speaker and the low frequency speaker are driven by their respective voice coil assemblies and magnet assemblies when the speaker assembly 10A receives an electrical audio signal or signals from an amplifier or other source. The voice coil assembly and magnet assembly of the low frequency speaker directly drives the woofer diaphragm and indirectly drives the cap via the woofer diaphragm. Similarly, the voice coil assembly and magnet assembly of the high frequency speaker drives its sound reproducing membrane, and the resultant sound waves are shaped and directed outwardly by the wave guide horn. Importantly, because the inside diameter edge of the cap 48A is positioned adjacent to the mouth 24A of the wave guide horn 20A (or adjacent the outer edge or outer termination of the sound reproducing membrane 18A when no horn is provided), sound waves from the high frequency speaker pass smoothly over the outer face of the cap with fewer detrimental reflections.

Figure 5:
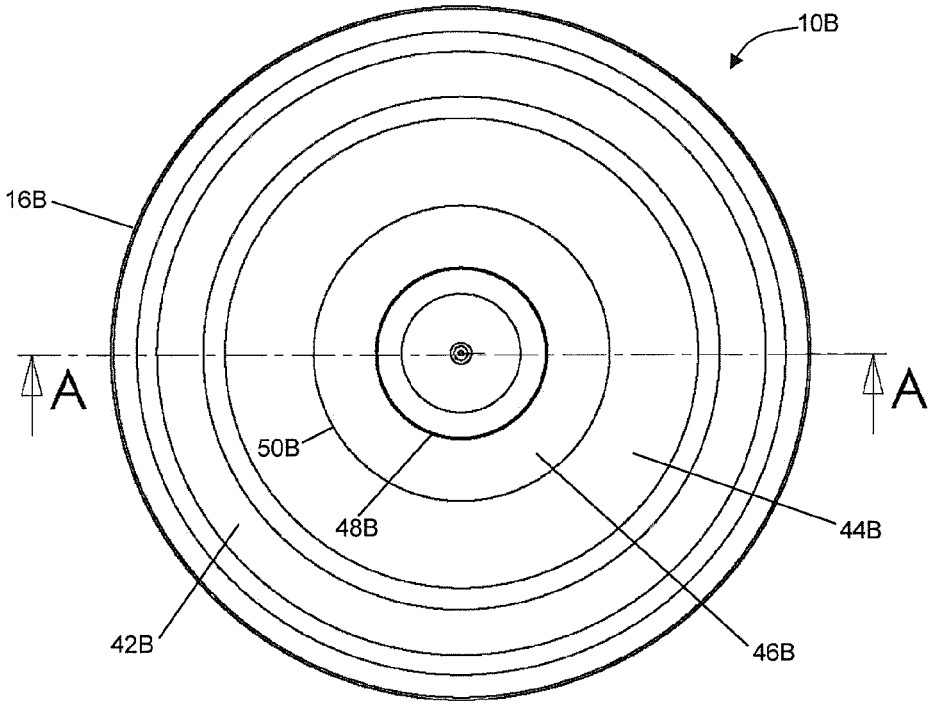
FIG. 5 is a plan or top view of a speaker assembly constructed in accordance with a third embodiment of the present invention.
Figure 6:
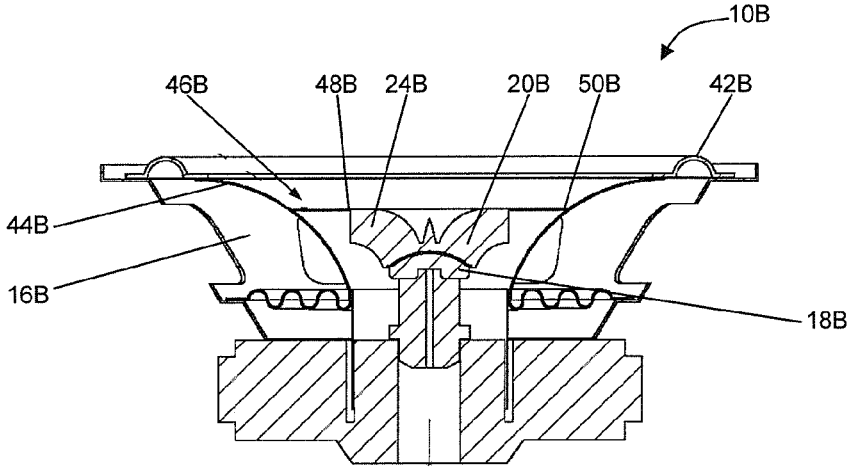
FIG. 6 is a vertical section view of the speaker assembly of FIG. 5 taken along the line A-A.

FIGS. 5 and 6 illustrate a speaker assembly 10B constructed in accordance with a third embodiment of the invention. Most of the components of the speaker assembly 10B are identical to the components of the speaker assembly 10A, with the only difference being the shape of the cap. In the speaker assembly 10B, the cap 46B is generally flat and has an inside diameter edge 48B positioned adjacent to the mouth 24B of the high frequency speaker wave guide horn 20B (or adjacent the outer edge or outer termination of the sound reproducing membrane 18B when no horn is provided) and an outside diameter edge 50B connected to a portion of the woofer diaphragm 44B. The flat cap 46B is preferably co-planar with the mouth 24B of the wave guide horn, but it may be recessed or raised to occupy a plane that is generally parallel to the plane occupied by the mouth of the wave guide horn. As with the cap of the speaker assembly 10A, the cap 46B may be formed of any suitable material including paper, cardboard, plastic, or even metal. In one embodiment, the cap is approximately 0.7 mm thick and has a 95 mm diameter outside edge and a 55 mm diameter inside edge. The speaker assembly 10B operates in substantially the same manner as the speaker assembly 10A.

Figure 7:
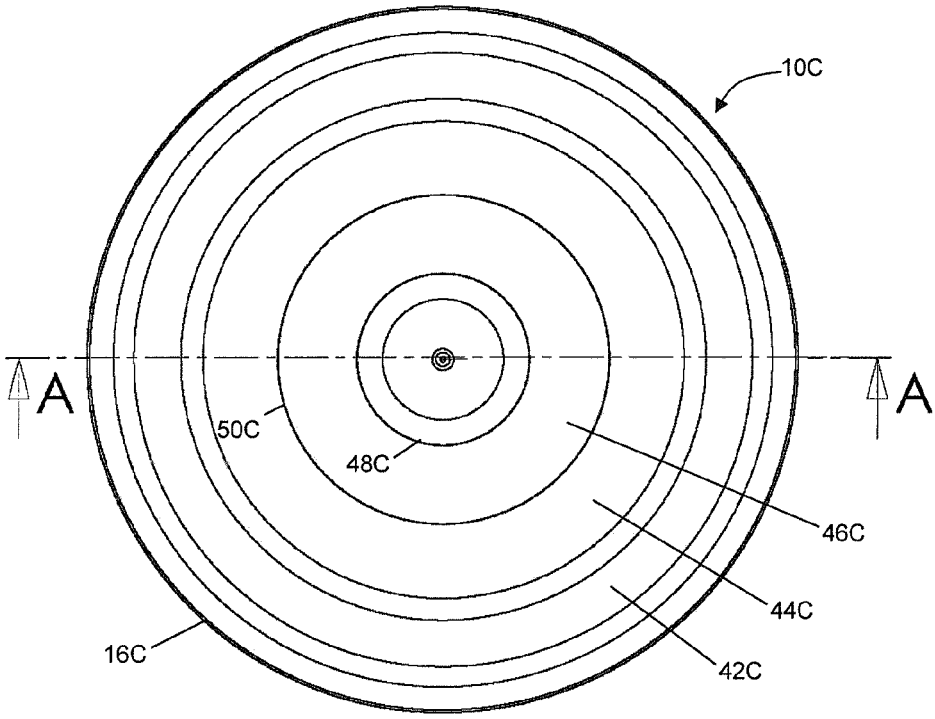
FIG. 7 is a plan or top view of a speaker assembly constructed in accordance with a fourth embodiment of the present invention.
Figure 8:
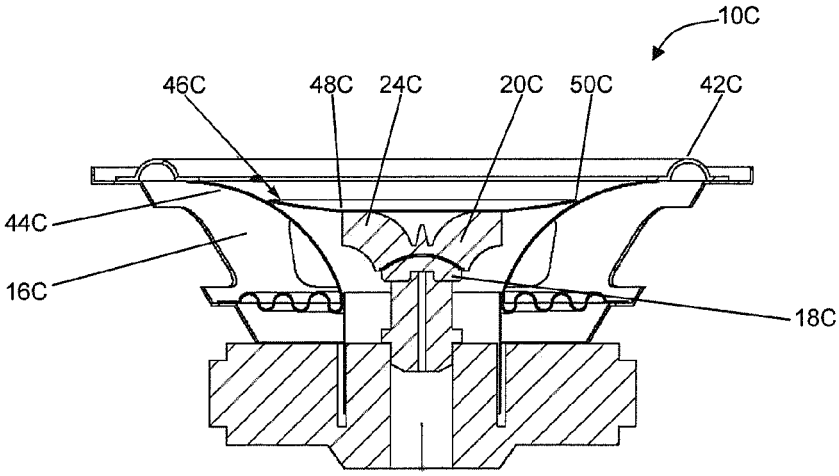
FIG. 8 is a vertical section view of the speaker assembly of FIG. 7 taken along the line A-A.

FIGS. 7 and 8 illustrate a speaker assembly 10C constructed in accordance with a fourth embodiment of the invention. Most of the components of the speaker assembly 10C are identical to the components of the speaker assemblies 10A and 10B, with the only difference being the shape of the cap 46C. In the speaker assembly 10C, the cap 46C is concave shaped and has an inside diameter edge 48C positioned adjacent to the mouth 24C of the high frequency speaker wave guide horn 20C (or adjacent the outer edge or outer termination of the sound reproducing membrane 18C when no horn is provided) and an outside diameter edge 50C connected to a portion of the woofer diaphragm. The cap 46C may be formed of any suitable material including paper, cardboard, plastic, or even metal. In one embodiment, the cap is approximately 2 mm thick and has a 95 mm diameter outside edge and a 55 mm diameter inside edge. In other embodiments, the cap may be between 1-5 mm thick, 50-150 mm in outside diameter, and 20-90 mm in inside diameter. The speaker assembly 10C operates in substantially the same manner as the speaker assemblies 10A and 10B.

Figure 9:
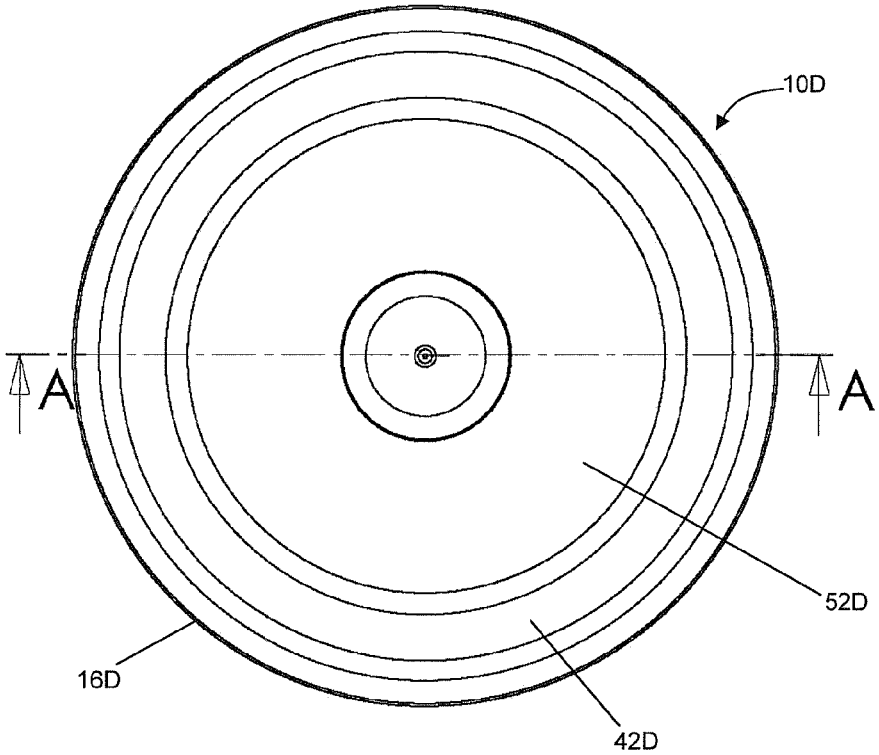
FIG. 9 is a plan or top view of a speaker assembly constructed in accordance with a fifth embodiment of the present invention.
Figure 10:
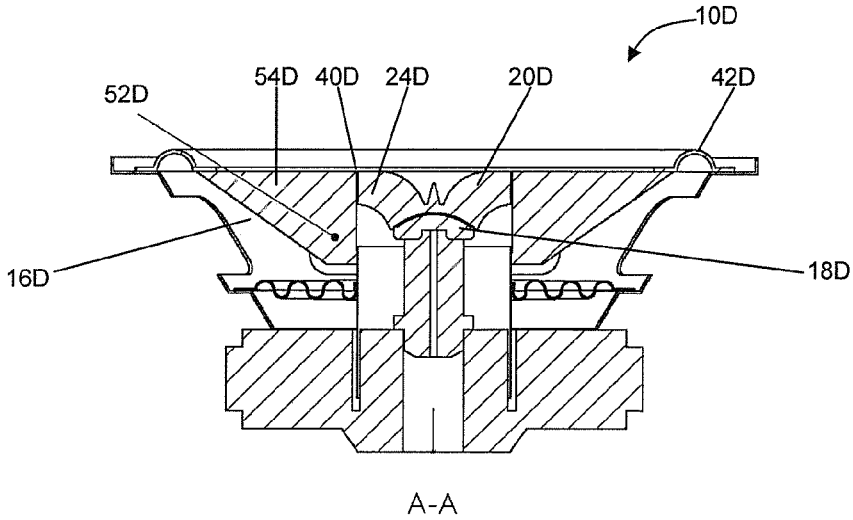
FIG. 10 is a vertical section view of the speaker assembly of FIG. 9 taken along the line A-A.

FIGS. 9 and 10 illustrate a speaker assembly 10D constructed in accordance with a fifth embodiment of the invention. Most of the components of the speaker assembly 10D are identical to the components of the speaker assembly 10, so only the differences are described herein. In the speaker assembly 10D, the low frequency speaker sound reproducing membrane assembly consists solely of a rigid woofer diaphragm 52D. The woofer diaphragm may be formed of any suitable material such as lightweight rigid plastic foam, honeycomb material, or other sandwich materials with a lightweight internal structure and includes an inner diameter edge connected to its voice coil assembly and an outer diameter edge connected directly to a flexible surround 42D. In this embodiment, the rigid woofer diaphragm 52D has a substantially flat outer surface 54D that is generally co-planar with the plane occupied by the mouth 24D of the wave guide horn 20D (or adjacent and generally co-planar with the outer edge or outer termination of the sound reproducing membrane 18D when no horn is provided). The outer surface of the solid woofer diaphragm may also be concave-shaped, convex-shaped, frustro-conical-shaped, conical-shaped, flared conical-shaped, or of any other shape. However, the plane containing the inner diameter edge 40D of the rigid woofer diaphragm should generally be co-planar with the plane containing the mouth 24D of the wave guide horn 20D (or the plane of the base of the high frequency sound reproducing membrane 18D when no horn is provided).

The speaker assembly 10D operates in a similar manner as the speaker assembly 10. Specifically, the sound reproducing membrane assemblies of the high frequency speaker and the low frequency speaker are driven by their respective voice coil assemblies and magnet assemblies when the speaker assembly 10D receives an electrical audio signal or signals from an amplifier or other source. The voice coil assembly and magnet assembly of the low frequency speaker directly drives the rigid woofer diaphragm. Similarly, the voice coil assembly and magnet assembly of the high frequency speaker drives its sound reproducing membrane, and the resultant sound waves are shaped and directed outwardly by the wave guide horn. Importantly, because the inside diameter edge of the rigid woofer diaphragm is positioned adjacent to the mouth of the wave guide horn (or adjacent outer edge or outer termination of the high frequency speaker sound reproducing membrane 18D when no horn is provided), sound waves from the high frequency speaker pass smoothly over the outer face of the ring-shaped diaphragm without any significant reflections.

Figure 11:
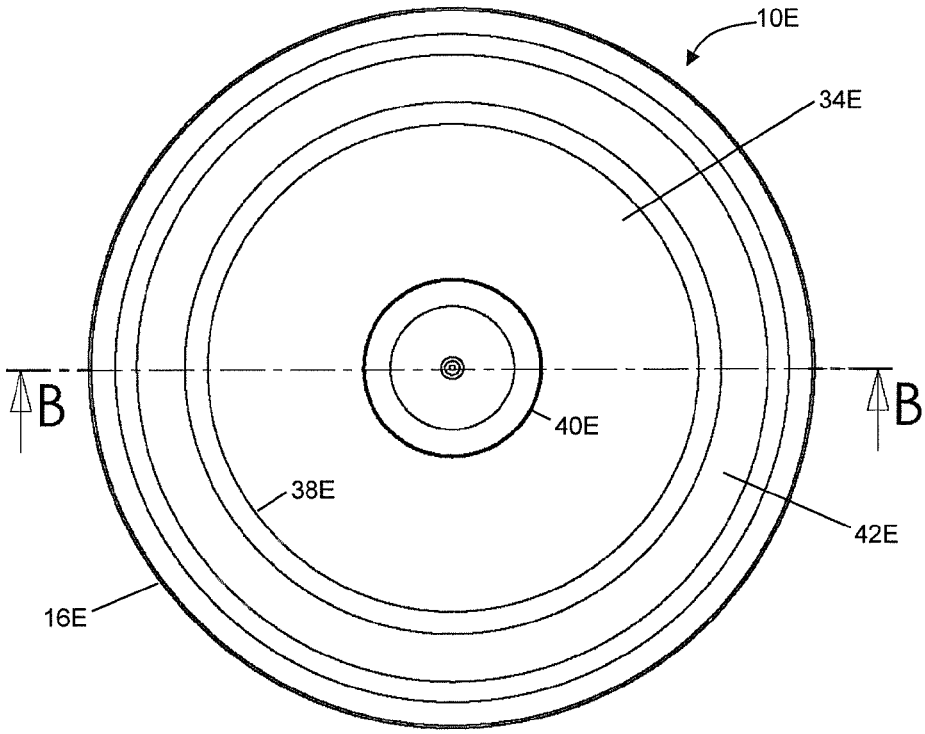
FIG. 11 is a plan or top view of a speaker assembly constructed in accordance with a sixth embodiment of the present invention.
Figure 12:
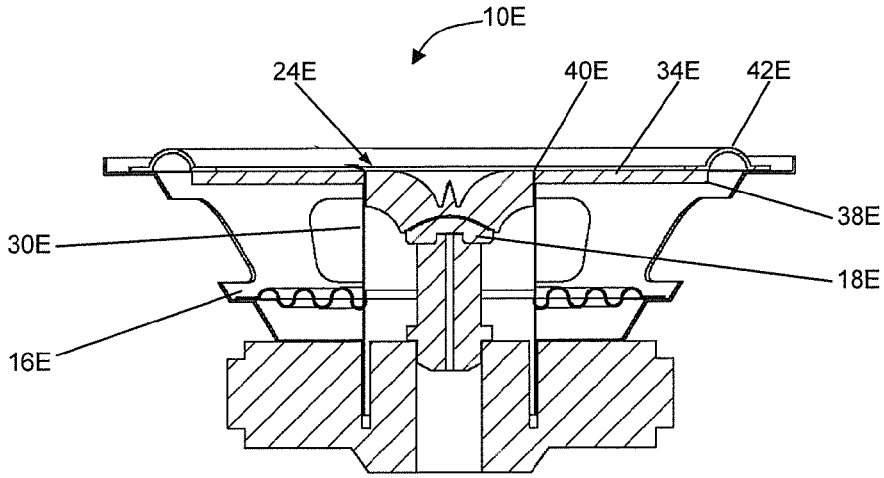
FIG. 12 is a vertical section view of the speaker assembly of FIG. 11 taken along the line B-B.

FIGS. 11 and 12 illustrate a speaker assembly 10E constructed in accordance with a sixth embodiment of the invention. Most of the components of the speaker assembly 10E are identical to the components of the speaker assembly 10, so only the differences are described herein. In the speaker assembly 10E, the voice coil assembly 30E of the low frequency speaker is taller than the voice coil assembly 30 of the speaker assembly 10 so that the voice coil assembly extends up to and connects directly to the inside diameter edge 40E of the flat ring-shaped diaphragm 34E. This eliminates the need for a separate driving element, as the ring-shaped diaphragm is driven directly by its voice coil assembly.

The speaker assembly 10E operates in a similar manner as the speaker assembly 10. Specifically, the sound reproducing membrane assemblies of the high frequency speaker and the low frequency speaker are driven by their respective voice coil assemblies and magnet assemblies when the speaker assembly 10E receives an electrical audio signal or signals from an amplifier or other source. The voice coil assembly and magnet assembly of the low frequency speaker directly drives the ring-shaped diaphragm and the voice coil assembly and magnet assembly of the high frequency speaker drives its sound reproducing membrane. The resultant sound waves of the high frequency speaker are shaped and directed outwardly by the wave guide horn. Importantly, because the inside diameter edge of the ring-shaped diaphragm is positioned adjacent to the mouth of the wave guide horn (or adjacent the outer edge or outer termination of the sound reproducing membrane 18E when no horn is provided), sound waves from the high frequency speaker pass smoothly over the outer face of the ring-shaped diaphragm without any significant detrimental reflections.

Figure 13:
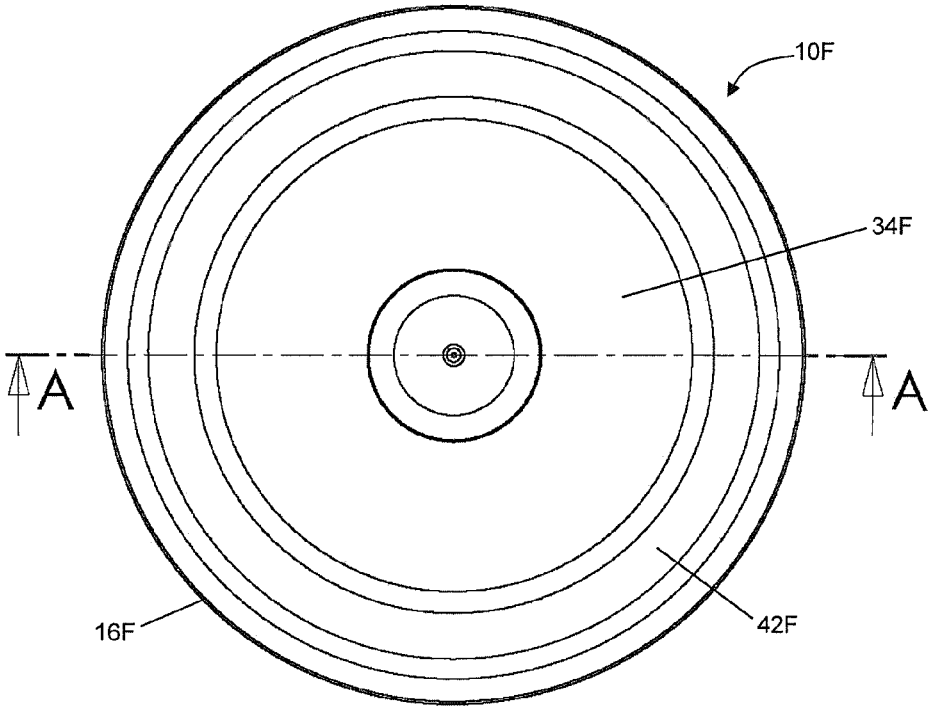
FIG. 13 is a plan or top view of a speaker assembly constructed in accordance with a seventh embodiment of the present invention.
Figure 14:
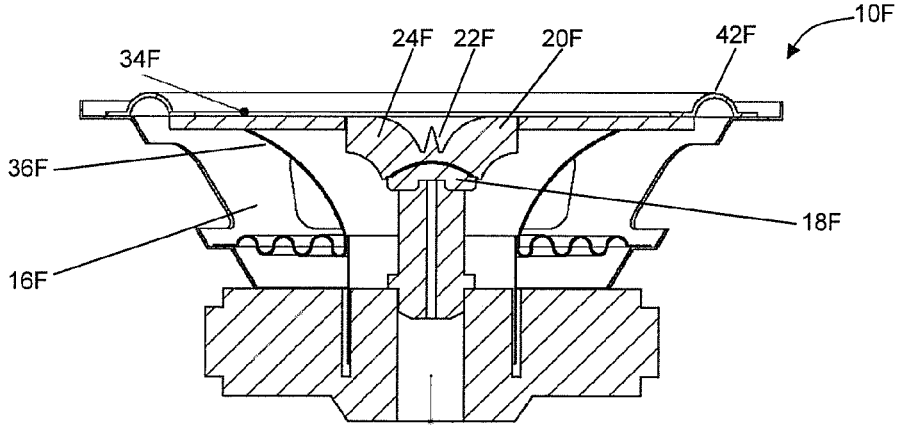
FIG. 14 is a vertical section view of the speaker assembly of FIG. 14 taken along the line A-A.

FIGS. 13 and 14 illustrate a speaker assembly 10F constructed in accordance with a seventh embodiment of the invention. Most of the components of the speaker assembly 10F are identical to the components of the speaker assembly 10, the only significant difference being that the driving element 36F has less of a flare and is connected to the underside of the flat ring-shaped diaphragm 34F at a point closer to the center of the flat ring-shaped diaphragm. Otherwise, the speaker assembly 10F operates in the same manner as the speaker assembly 10.

Although the invention has been described with reference to the preferred embodiment illustrated in the attached drawing figures, it is noted that equivalents may be employed and substitutions made herein without departing from the scope of the invention as recited in the claims. For example, some of the particular shapes, sizes, materials, and other characteristics of the speaker system components may be altered without departing from the scope of the invention.

Having thus described the preferred embodiment of the invention, what is claimed as new and desired to be protected by Letters Patent includes the following:

1. A loudspeaker assembly comprising:

a high frequency speaker including— a sound reproducing membrane, a voice coil assembly and magnet assembly for actuating the sound reproducing membrane in response to an electrical audio signal, and a wave guide horn for directing sound waves produced by the sound reproducing membrane, the wave guide horn having a throat disposed adjacent the sound reproducing membrane and a mouth disposed opposite the throat; and a low frequency speaker including— a sound reproducing membrane assembly, a substantially flat ring-shaped diaphragm with an inside diameter edge positioned adjacent the mouth of the wave guide horn, and a voice coil assembly and magnet assembly for actuating the sound reproducing membrane assembly in response to an electrical audio signal;

wherein at least a portion of the low frequency speaker sound reproducing membrane assembly is positioned adjacent the mouth of the wave guide horn to inhibit sound waves produced by the high frequency speaker reflecting off the low frequency speaker from having increased path length or travel times compared to the direct sound radiated from the high frequency speaker.

2. The loudspeaker assembly as set forth in claim 1, wherein the portion of the low frequency speaker sound reproducing membrane assembly which is adjacent the mouth of the wave guide horn is generally co-planar with the mouth of the wave guide horn.

3. The loudspeaker assembly as set forth in claim 1, wherein the low frequency speaker sound reproducing membrane assembly includes— a driving element positioned between the ring-shaped diaphragm and the low frequency speaker voice coil assembly for transferring vibrations from the voice coil assembly to the ring-shaped diaphragm.

4. The loudspeaker assembly as set forth in claim 3, wherein the ring-shaped diaphragm has an outside diameter edge attached to a flexible surround, and wherein the driving element is attached to an underside of the ring-shaped diaphragm at a point below or near the flexible surround.

5. The loudspeaker assembly as set forth in claim 1, wherein the low frequency speaker sound reproducing membrane assembly includes— a woofer diaphragm having an inner diameter edge connected to the voice coil assembly and an outer diameter edge connected to a flexible surround, and a convex shaped cap with an inside diameter edge positioned adjacent to the mouth of the wave guide horn and an outside diameter edge connected to a portion of the woofer diaphragm.

6. The loudspeaker assembly as set forth in claim 1, wherein the low frequency speaker sound reproducing membrane assembly includes— a woofer diaphragm having an inner diameter edge connected to the voice coil assembly and an outer diameter edge connected to a flexible surround, and a relatively flat cap with an inside diameter edge positioned adjacent to the mouth of the wave guide horn and an outside diameter edge connected to a portion of the woofer diaphragm.

7. The loudspeaker assembly as set forth in claim 1, wherein the low frequency speaker sound reproducing membrane assembly includes— a woofer diaphragm having an inner diameter edge connected to the voice coil assembly and an outer diameter edge connected to a flexible surround, and a concave shaped cap with an inside diameter edge positioned adjacent to the mouth of the wave guide horn and an outside diameter edge connected to a portion of the woofer diaphragm.

8. The loudspeaker assembly as set forth in claim 1, wherein the low frequency speaker sound reproducing membrane assembly is a substantially rigid woofer diaphragm having a generally flat outer surface that is generally coplanar with the mouth of the wave guide horn.

9. The loudspeaker assembly as set forth in claim 8, wherein the substantially rigid woofer diaphragm is formed of lightweight rigid plastic foam, honeycomb material, or other sandwich materials with a lightweight internal structure.

10. The loudspeaker assembly as set forth in claim 1, wherein the low frequency speaker sound reproducing membrane assembly is a woofer diaphragm having an outer surface that is adjacent to the mouth of the wave guide horn and that is generally concave-shaped, convex-shaped, conical-shaped, or flared conical-shaped.

11. The loudspeaker assembly as set forth in claim 10, wherein the woofer diaphragm is substantially rigid and formed of lightweight rigid plastic foam, honeycomb material, or other sandwich materials with a lightweight internal structure.

12. The loudspeaker assembly as set forth in claim 1, wherein the low frequency speaker sound reproducing membrane assembly is a generally flat ring-shaped diaphragm with an inside diameter edge positioned adjacent the mouth of the wave guide horn and an outside diameter edge connected to a flexible surround, wherein the low frequency speaker voice coil assembly is attached directly to the inside diameter edge of the ring-shaped diaphragm for directly actuating the ring-shaped diaphragm.

13. A loudspeaker assembly comprising:

a high frequency speaker including a sound reproducing membrane and a voice coil assembly and magnet assembly for actuating the sound reproducing membrane in response to an electrical audio signal; and a low frequency speaker including a sound reproducing membrane assembly, a voice coil assembly and magnet assembly for actuating the sound reproducing membrane assembly in response to an electrical audio signal, and a substantially flat ring-shaped diaphragm with an inside diameter edge positioned adjacent the high frequency speaker sound reproducing membrane;

wherein at least a portion of the low frequency speaker sound reproducing membrane assembly is positioned adjacent an outer edge of the sound reproducing membrane of the high frequency speaker to inhibit sound waves produced by the high frequency speaker reflecting off the low frequency speaker from having increased path length or travel times compared to the direct sound radiated from the high frequency speaker.

14. The loudspeaker assembly as set forth in claim 13, wherein the portion of the low frequency speaker sound reproducing membrane which is adjacent the outer edge of the sound reproducing membrane is generally co-planar with the outer edge of the sound reproducing membrane.

15. The loudspeaker assembly as set forth in claim 13, wherein the low frequency speaker sound reproducing membrane assembly includes— a driving element positioned between the ring-shaped diaphragm and the low frequency speaker voice coil assembly for transferring vibrations from the voice coil assembly to the ring-shaped diaphragm.

16. The loudspeaker assembly as set forth in claim 15, wherein the ring-shaped diaphragm has an outside diameter edge attached to a flexible surround, and wherein the driving element is attached to an underside of the ring-shaped diaphragm at a point below or near the flexible surround.

17. The loudspeaker assembly as set forth in claim 13, wherein the low frequency speaker sound reproducing membrane assembly includes— a woofer diaphragm having an inner diameter edge connected to the voice coil assembly and an outer diameter edge connected to a flexible surround, and a convex shaped cap with an inside diameter edge positioned adjacent to the high frequency sound reproducing membrane and an outside diameter edge connected to a portion of the woofer diaphragm.

18. The loudspeaker assembly as set forth in claim 13, wherein the low frequency speaker sound reproducing membrane assembly includes— a woofer diaphragm having an inner diameter edge connected to the voice coil assembly and an outer diameter edge connected to a flexible surround, and a relatively flat cap with an inside diameter edge positioned adjacent to the high frequency speaker sound reproducing membrane and an outside diameter edge connected to a portion of the woofer diaphragm.

19. The loudspeaker assembly as set forth in claim 13, wherein the low frequency speaker sound reproducing membrane assembly includes— a woofer diaphragm having an inner diameter edge connected to the voice coil assembly and an outer diameter edge connected to a flexible surround, and a concave shaped cap with an inside diameter edge positioned adjacent to the high frequency speaker sound reproducing membrane and an outside diameter edge connected to a portion of the woofer diaphragm.

20. The loudspeaker assembly as set forth in claim 13, wherein the low frequency speaker sound reproducing membrane assembly is a substantially rigid woofer diaphragm having a generally flat outer surface that is generally coplanar with the outer edge of the high frequency speaker sound reproducing membrane.

21. The loudspeaker assembly as set forth in claim 20, wherein the substantially rigid woofer diaphragm is formed of lightweight rigid plastic foam, honeycomb material, or other sandwich materials with a lightweight internal structure.

22. The loudspeaker assembly as set forth in claim 13, wherein the low frequency speaker sound reproducing membrane assembly is a woofer diaphragm having an outer surface that is adjacent to the outer edge of the high frequency speaker sound reproducing membrane and that is generally concave-shaped, convex-shaped, conical-shaped, or flared conical-shaped.

23. The loudspeaker assembly as set forth in claim 22, wherein the woofer diaphragm is substantially rigid and formed of lightweight rigid plastic foam, honeycomb material, or other sandwich materials with a lightweight internal structure.

24. The loudspeaker assembly as set forth in claim 13, wherein the low frequency speaker sound reproducing membrane assembly is a generally flat ring-shaped diaphragm with an inside diameter edge positioned adjacent the outer edge of the high frequency speaker sound reproducing membrane and an outside diameter edge connected to a flexible surround, wherein the low frequency speaker voice coil assembly is attached directly to the inside diameter edge of the ring-shaped diaphragm for directly actuating the ring-shaped diaphragm.

25. A loudspeaker assembly comprising:

a high frequency speaker including a sound reproducing membrane and a voice coil assembly and magnet assembly for actuating the sound reproducing membrane in response to an electrical audio signal; and a low frequency speaker including a sound reproducing membrane assembly, a voice coil assembly and magnet assembly for actuating the sound reproducing membrane assembly in response to an electrical audio signal, a substantially flat ring-shaped diaphragm with an inside diameter edge positioned adjacent the high frequency speaker sound reproducing membrane and an outside diameter edge attached to a flexible surround, and a driving element positioned between the ring-shaped diaphragm and the low frequency speaker voice coil assembly for transferring vibrations from the voice coil assembly to the ring-shaped diaphragm, the driving element attached to an underside of the ring-shaped diaphragm at a point below or near the flexible surround, wherein at least a portion of the low frequency speaker sound reproducing membrane assembly is positioned adjacent an outer edge of the sound reproducing membrane of the high frequency speaker to inhibit sound waves produced by the high frequency speaker reflecting off the low frequency speaker from having increased path length or travel times compared to the direct sound radiated from the high frequency speaker.

* * * * *